US006685508B2

(12) United States Patent
Zhu et al.

(10) Patent No.: US 6,685,508 B2
(45) Date of Patent: Feb. 3, 2004

(54) USB CONNECTOR ASSEMBLY HAVING REDUCED MATING HEIGHT

(75) Inventors: ZiQiang Zhu, Kunsan (CN); Young Zhang, Kunsan (CN)

(73) Assignee: Hon Hai Precision Inc. Co., Ltd., Taipei Hsien (TW)

( * ) Notice: Subject to any disclaimer, the term of this patent is extended or adjusted under 35 U.S.C. 154(b) by 193 days.

(21) Appl. No.: 10/041,041

(22) Filed: Dec. 28, 2001

(65) Prior Publication Data

US 2003/0124909 A1 Jul. 3, 2003

(51) Int. Cl.[7] ..... H01R 13/648
(52) U.S. Cl. ..... 439/607; 439/608
(58) Field of Search ..... 439/607, 608, 439/609, 541.5, 674, 660, 295, 284, 639, 83, 79–80, 676, 490, 610

(56) References Cited

U.S. PATENT DOCUMENTS 6,186,830 B1 * 2/2001 Lin et al. ..... 439/607
6,224,422 B1 * 5/2001 Zhu et al. ..... 439/607
6,309,227 B1 * 10/2001 Chen et al. ..... 439/79
6,383,024 B1 * 5/2002 Wang et al. ..... 439/607
6,478,610 B1 * 11/2002 Zhou et al. ..... 439/490
2002/0048992 A1 * 4/2002 Wang et al. ..... 439/607

* cited by examiner

*Primary Examiner*—Jean F. Duverne
(74) *Attorney, Agent, or Firm*—Wei Te Chung

(57) ABSTRACT

A Universal Serial Bus (USB) connector assembly includes a plug (1) and a receptacle (2). The plug has a first housing (10) with a front mating tongue (13), a plurality of terminals (20) received in the first housing, and a first shield (30) enclosing the first housing. The first shield has an inverted U-shaped portion (321) for covering the mating tongue and the dimensions of the mating tongue is smaller than the remaining part of the first housing. The receptacle has a second housing (50), a plurality of contacts (60) received in the second housing, and a second shield (70) enclosing the second housing. The second housing defines a bottom surface (521) abutting against an inner surface of a bottom plate (72) of the second shield, and a top surface (520) spaced from a top plate (71) of the second shield.

4 Claims, 6 Drawing Sheets

USB CONNECTOR ASSEMBLY HAVING REDUCED MATING HEIGHT

BACKGROUND OF THE INVENTION

1. Field of the Invention

The present invention relates to a Universal Serial Bus (USB) connector assembly, and particularly to a USB connector assembly having a reduced mating height.

2. Description of Related Art

FIG. 6 discloses a conventional mini-USB connector assembly comprising a plug connector 5 and a receptacle connector 6 for mating with the plug connector 5. A mating head 51 of the plug connector 5 is completely inserted into and received in a rectangular mating opening 61 of the receptacle connector 6. The mating height of the plug and receptacle connectors 5 and 6 is designated as H'.

However, with the miniaturization of the electrical devices, it is desired that the electrical connectors used in the electrical devices and particularly used for transmitting data at a high speed be of small dimensions. Consequently, a mini-USB connector assembly which has a smaller mating height is required to meet the trend of miniaturization.

BRIEF SUMMARY OF THE INVENTION

The object of the present invention is to provide a USB connector assembly of a reduced mating height to thus decrease the occupied space.

To achieve the above-mentioned object, a USB connector assembly in accordance with the present invention includes a plug connector and a receptacle connector. The plug connector has a first housing with a front mating tongue, a plurality of terminals received in the first housing, and a first shield enclosing the first housing. The first shield has an inverted U-shaped portion for covering the mating tongue and the dimensions of the mating tongue is smaller than the retaining part of the first housing. The receptacle connector has a second housing, a plurality of contacts received in the second housing, and a second shield enclosing the second housing. The second housing defines a bottom surface abutting against an inner surface of a bottom plate of the second shield, and a top surface spaced from a top plate of the second shield.

Other objects, advantages and novel features of the invention will become more apparent from the following detailed description of the present embodiment when taken in conjunction with the accompanying drawings.

DETAILED DESCRIPTION OF THE INVENTION

Referring to FIGS. 1 through 4, a USB connector assembly in accordance with the present invention comprises a plug connector 1 and a receptacle connector 2.

Figure 1:
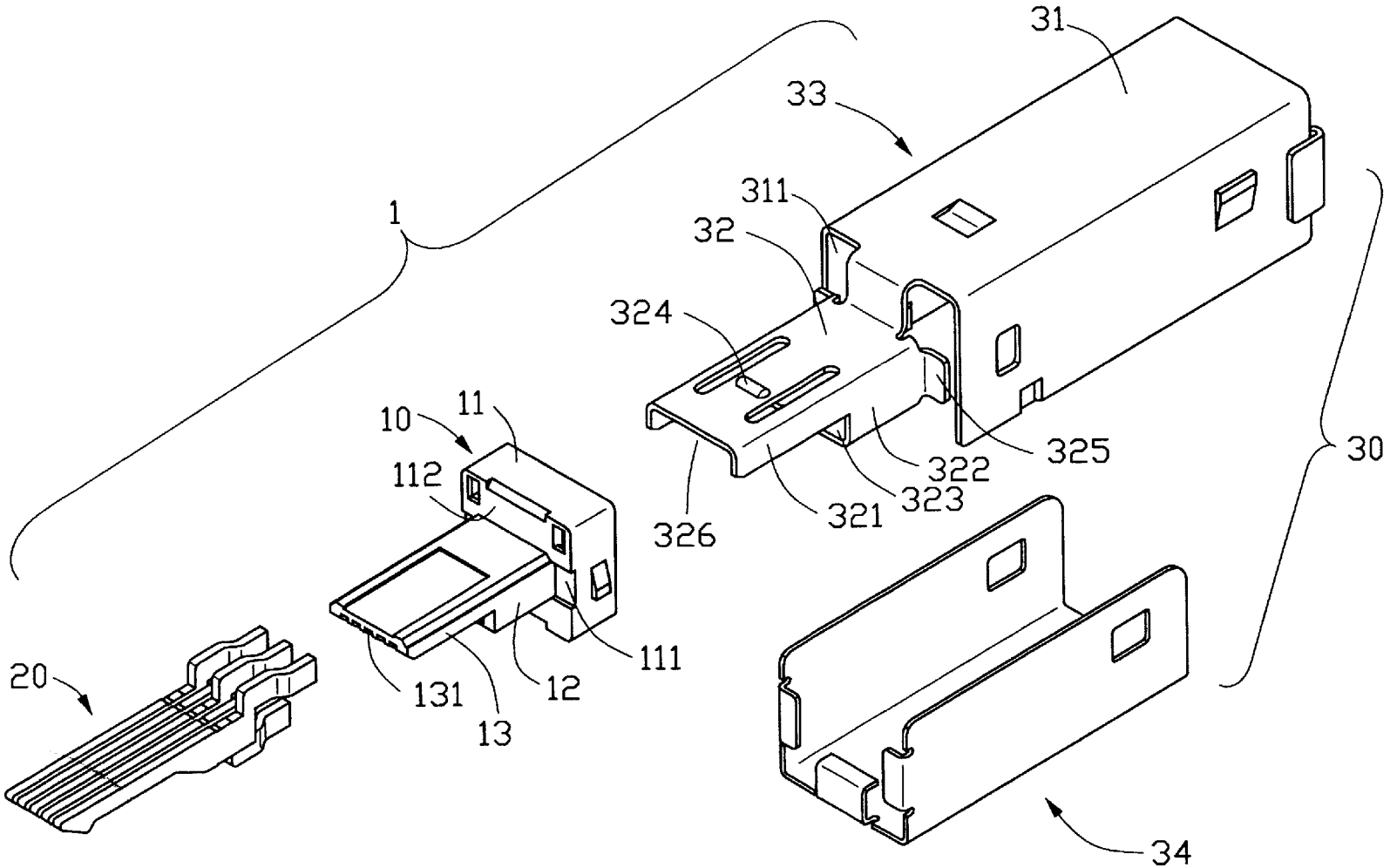
FIG. 1 is an exploded perspective view of a plug connector of a USB connector assembly in accordance with the present invention.
Figure 2:
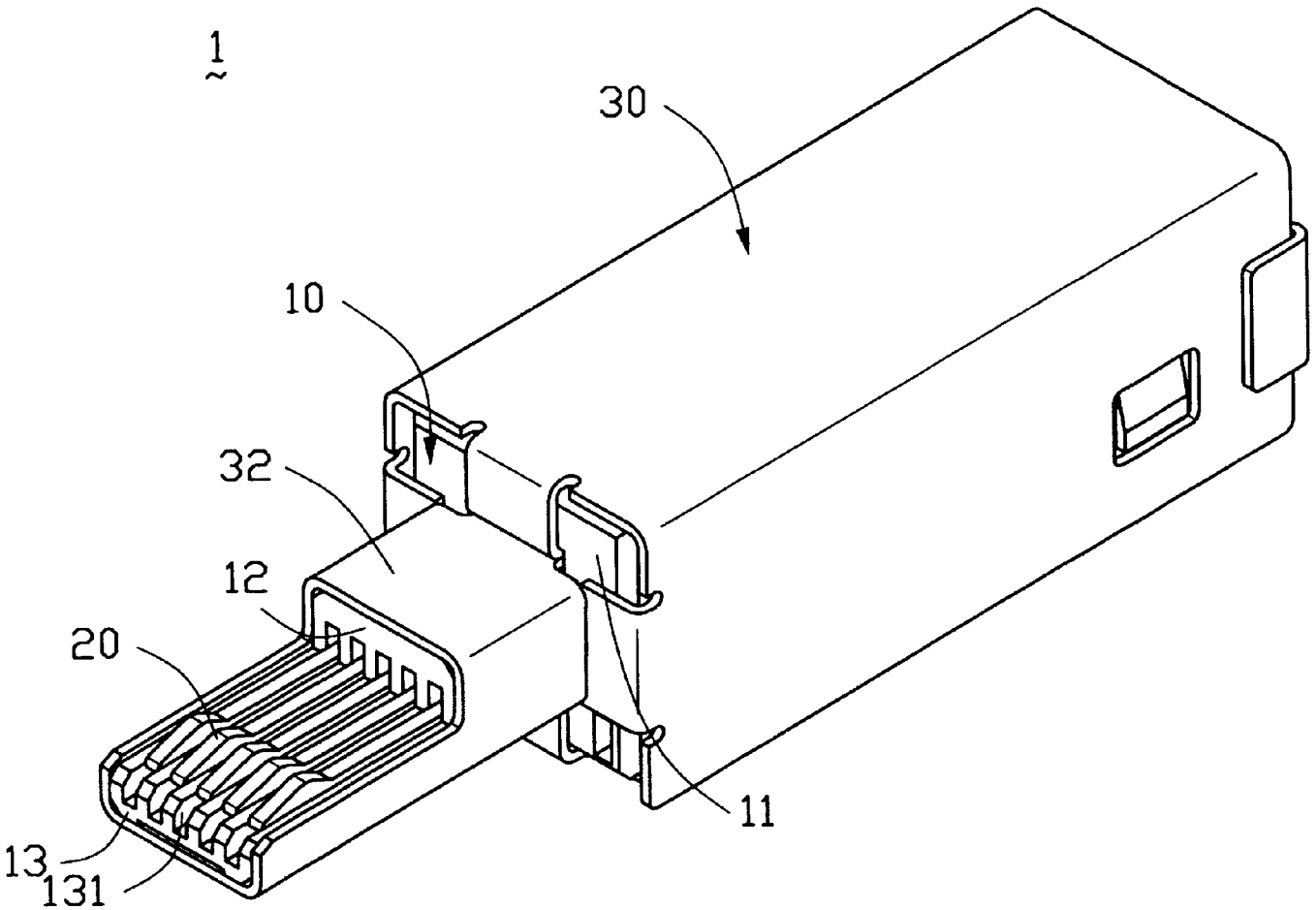
FIG. 2 is an upside-down, assembled view of the plug connector shown in FIG. 1.

The plug connector 1, as shown in FIGS. 1 and 2, includes a dielectric first housing 10, a plurality of terminals 20 accommodated in the dielectric first housing 10, and a first shield 30 comprising an upper shield 33 and a lower shield 34 together enclosing the dielectric first housing 10. The dielectric first housing 10 has a cuboid-shaped main body 11 at a rear end thereof and an elongated front body 12 extending forwards from a front face 112 of the main body 11. A mating tongue 13 is formed at a front end of the front body 12, which is lower than the front body 12. A plurality of passageways 131 are arrayed in the mating tongue 13 for receiving corresponding terminals 20. The front face 112 of the main body 11 defines a pair of recesses 111 on opposite sides of the front body 12.

The upper shield 33 includes an elongated rear section 31, and a front section 32 extending forwards from the rear section 31 and having dimensions smaller than the rear section 31. The front section 32 includes an inverted U-shaped portion 321 and a rear portion 322 with a channel 323 being defined therein. The inverted U-shaped portion 321 has a receiving passage 326 defined therethrough and communicating with the channel 323 for receiving the mating tongue 13. An engaging groove 311 is provided through the rear section 31 and in communication with the receiving passage 326 and the channel 323, which retains therein the main body 11 of the first housing 10 together with corresponding wires (not shown) connecting with the terminals 20. A protrusion 324 is formed on a topside of the inverted U-shaped portion 321 for correctly and securely mating with the receptacle connector 2. A pair of retaining pads 325 extend oppositely from a rear edge of the rear portion 322 for engaging with the pair of recesses 111. The lower shield 34 engages with the upper shield 33 from a bottom side thereof for substantially enclosing the dielectric housing 10 therein.

In assembly, the plurality of terminals 20 are first fixed into corresponding passageways 131 of the first housing 10 and then the first housing 10 with the terminals 20 is enclosed by the upper shield 33, whereby the main body 11 is received in the engaging opening 311, the rear of the front body 12 being received in the channel 323 and the mating tongue 13 is exposed in the receiving passage 326. Finally, the lower shield 34 is attached to the rear section 31 of the upper shield 33 from the bottom side.

Figure 3:
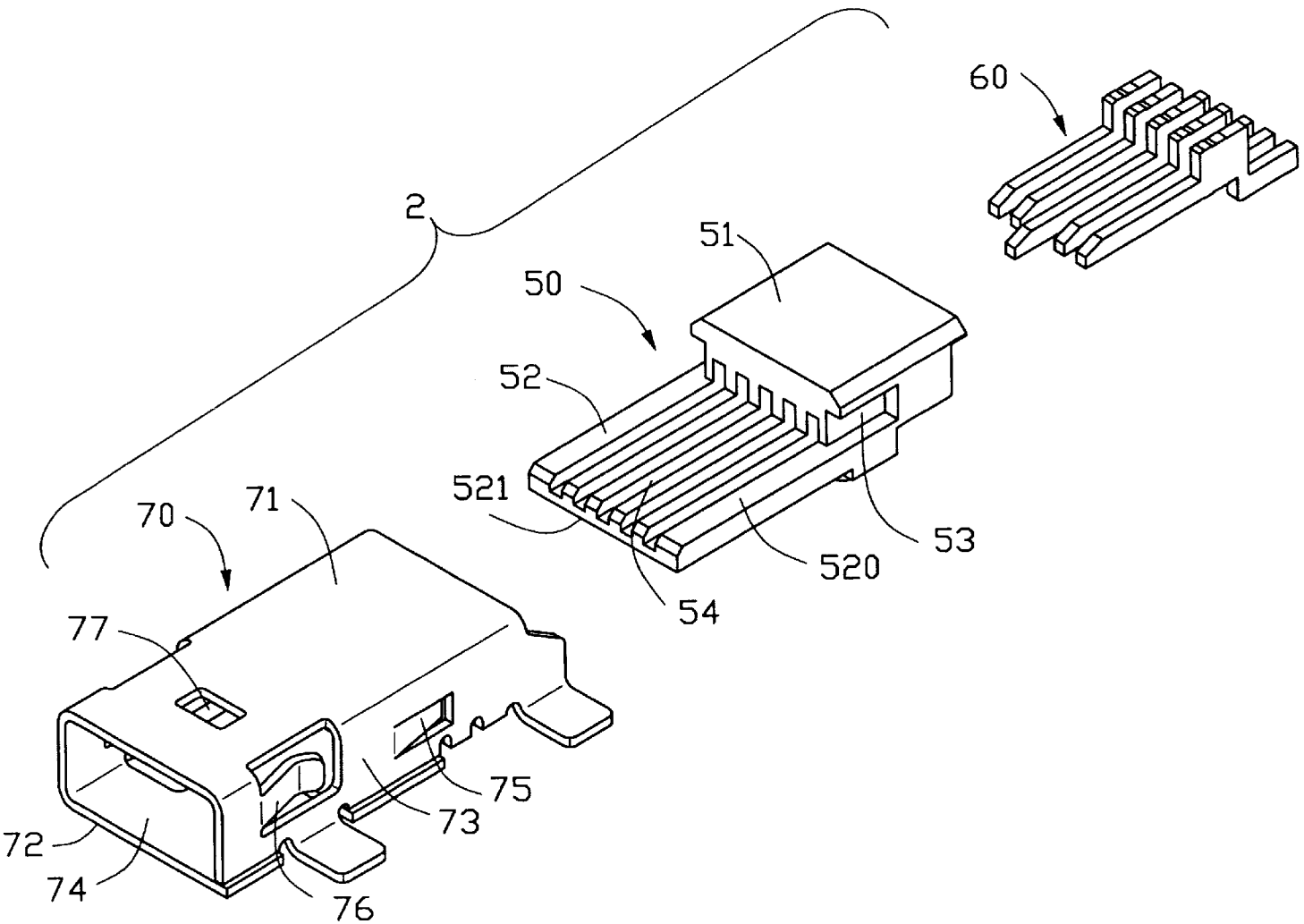
FIG. 3 is an exploded perspective view of a receptacle connector of the USB connector assembly in accordance with the present invention.
Figure 4:
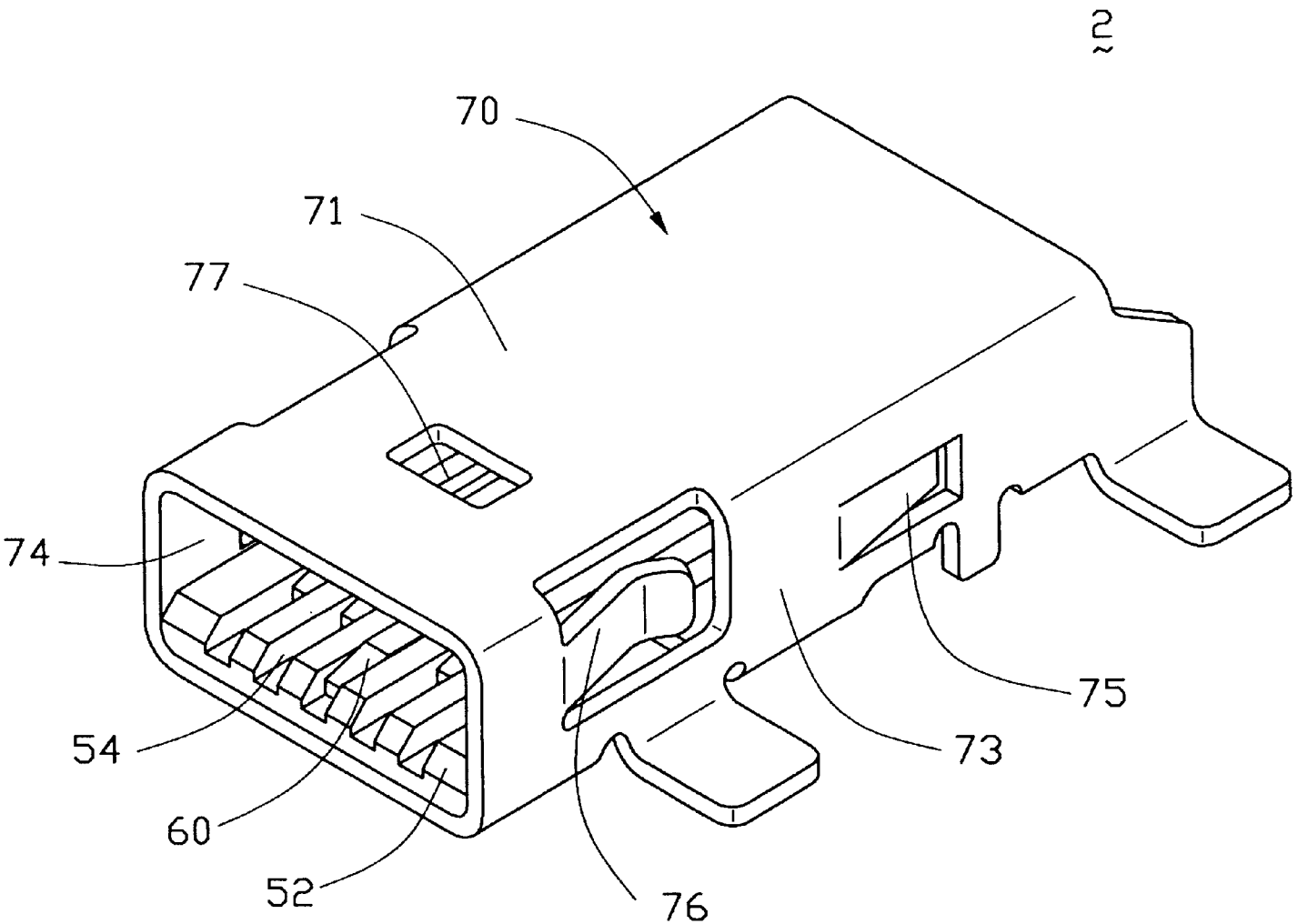
FIG. 4 is an assembled perspective view of the receptacle connector shown in FIG. 3.

Referring to FIGS. 3 and 4, the receptacle connector 2 of the USB connector assembly is shown. The receptacle connector 2 similarly includes a dielectric second housing 50, a plurality of contacts 60 received in the second housing 50, and a second shield 70 surrounding the dielectric second housing 50. The second housing 50 includes a main portion 51 and a tongue portion 52 extending forwardly from the main portion 51. A pair of cutouts 53 are defined in opposite sides of the main portion 51 adjacent to the tongue portion 52. A plurality of receiving slots 54 are defined in a top surface 520 of the tongue portion 52 for receiving corresponding contacts 60 therein.

The second shield 70 is integrally stamped from a metal sheet and configured in a cuboid shape. The second shield 70 defines a mating cavity 74 surrounded by a top plate 71, a bottom plate 72 and a pair of side plates 73 for receiving the plug connector 1 therein. Each side plate 73 has a resilient pad 76 stamped therein adjacent to a front end, which extends inwardly for resiliently securing the plug connector 1, and a retaining tab 75 stamped therefrom adjacent to a rear end, which extends inwards for being received in a corresponding cutout 53 of the second housing 50. A hole 77 is defined in the top plate 71 for engaging with the protrusion 324 of the first shield 30 of the plug connector 1.

In assembly, the plurality of contacts 60 are respectively accommodated in the slots 54 of the tongue portion 52, and the second housing 50 together with the contacts 60 therein is then inserted into and received in the mating cavity 74 from a rear side thereof for mating with the plug connector 1, whereby a bottom surface 521 of the tongue portion 52 abuts against an inner surface of the bottom plate 72 of the second shield 70, and the top surface 520 of the tongue portion 52 is spaced from the top plate 71 of the second shield 70. At the same time, the two retaining tabs 75 are received in respective cutouts 53 of the second housing 50.

Figure 5:
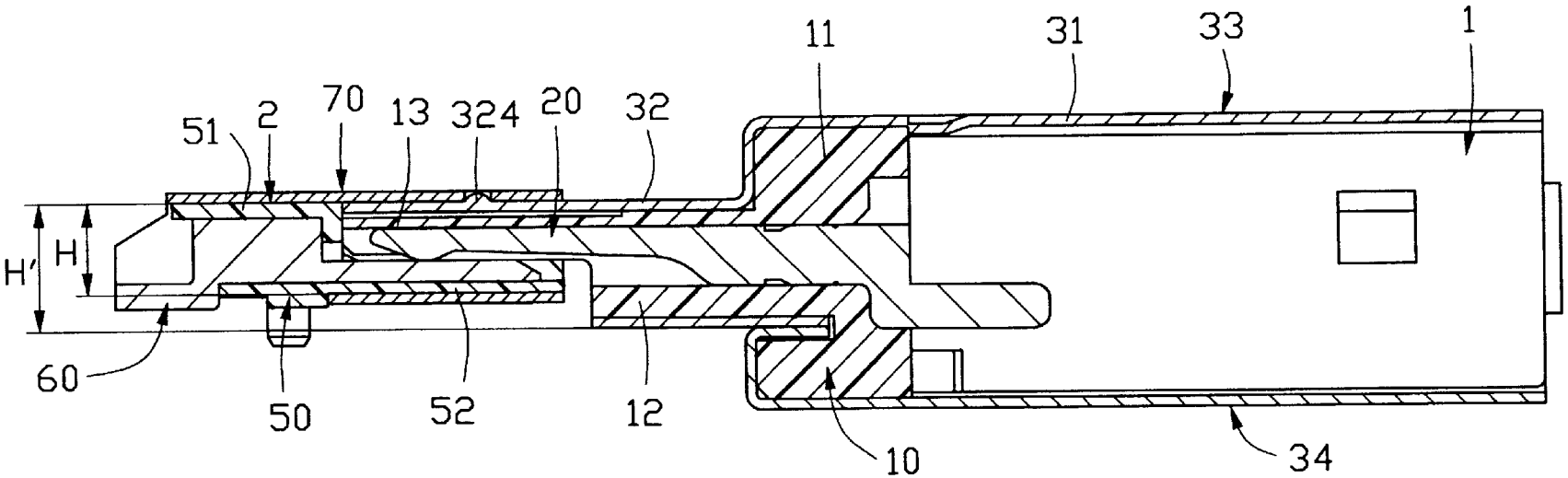
FIG. 5 is a cross-sectional view of the USB connector assembly showing the plug connector mating with the receptacle connector.
Figure 6:
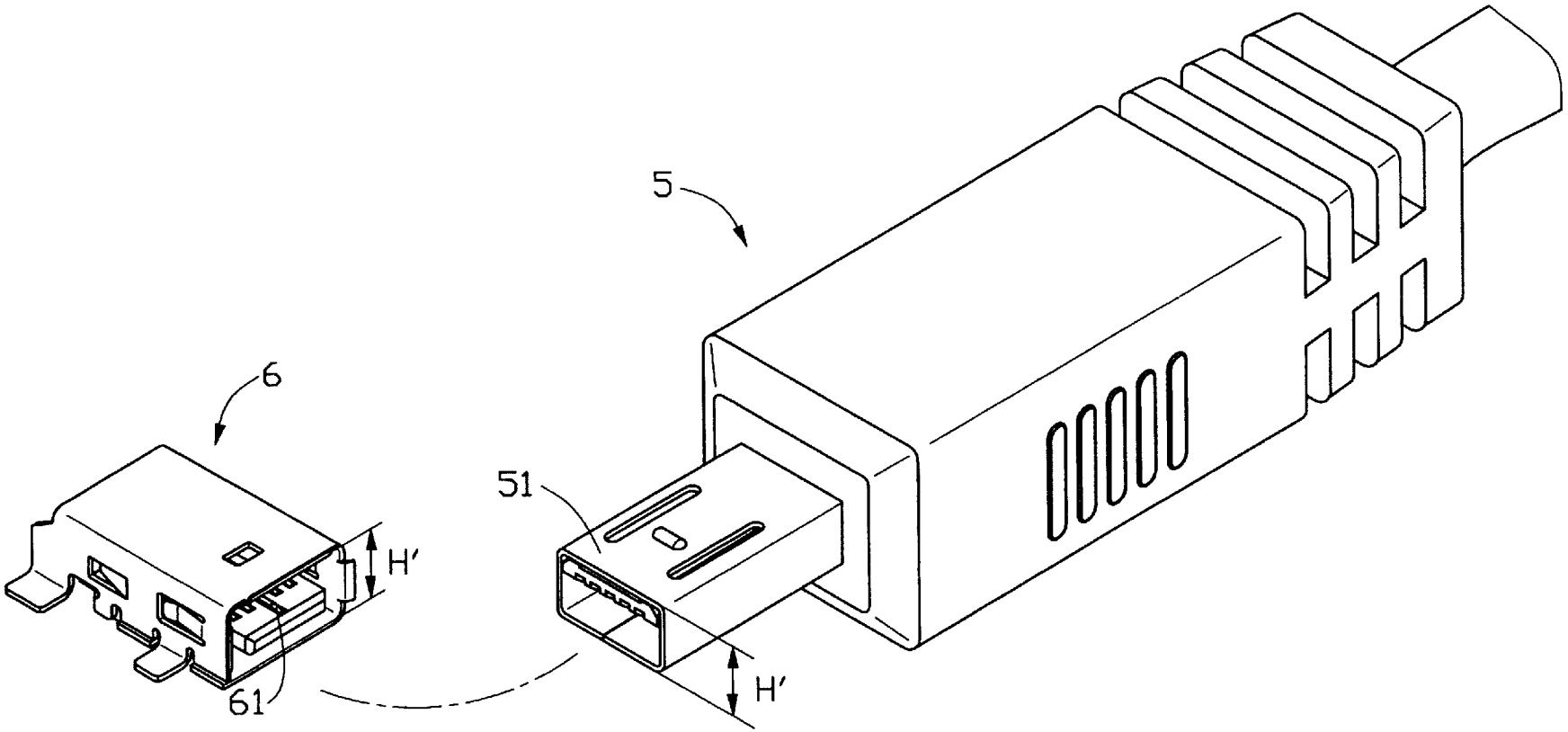
FIG. 6 (RELATED ART)
FIG. 6 is a perspective view of a plug connector and a receptacle connector of a related USB connector assembly.

FIG. 5 shows a cross-sectional view of the USB connector assembly illustrating a mating state between the receptacle connector 2 and the plug connector 1. It is easy to see that the mating height H of the plug connector 1 and the receptacle connector 2 is much smaller than the mating height H' of the conventional plug and receptacle connectors (FIG. 6). Compared with the prior art, the dimensions of the present invention is reduced, thereby not only decreasing the manufacturing cost but also economizing the costful space in an electrical device.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A plug connector comprising:

a dielectric housing having a main body, a front body extending forwards from said main body, and a mating tongue extending forwards from said front body, said dielectric housing defining a plurality of passageways therein;

a plurality of terminals accommodated in corresponding passageways of the dielectric housing; and an upper shield enclosing the dielectric housing, said upper shield having a rear section enclosing said main body and a front section extending from said rear section, dimensions of said front section being smaller than those of said rear section, said front section having an inverted U-shaped portion at a front end thereof and a rear portion connecting with said rear section, said inverted U-shaped portion defining a receiving passage therethrough for receiving said mating tongue and said rear portion defining a channel communicating with said receiving passage for receiving said front wherein dimensions of the mating tongue are smaller than those of remaining parts of the first housing.

2. The plug connector as described in claim 1, further comprising a lower shield engaged with said upper shield for enclosing the dielectric housing from a bottom side thereof.

3. The plug connector as described in claim 1, wherein said rear section of the upper shield defines an engaging groove communicating with said receiving passage and said channel for receiving said main body of the dielectric housing therein.

4. An electrical connector assembly comprising:

a first connector including a dielectric first housing defining a first body with a first tongue forwardly extending therefrom, said first tongue defining two opposite first mating and backing faces thereon;

a plurality of first contacts received in said first housing and extending in said first tongue;

a first metallic shield generally enclosing said fist housing;

a second connector including a dielectric second housing defining a second body with a second tongue forwardly extending therefrom, said second tongue defining two opposite second mating and backing faces thereon;

a plurality of second contacts received in said second housing and extending in said second tongue;

a second metallic shield generally enclosing said second housing; wherein when mated, from a cross-sectional view the first mating face and the second mating face engage each other with the corresponding first contacts and second contacts mechanically and electrically engaged with each other, under a condition that all of a front portion of the first shield is only sandwiched between said first backing face and said second shield.

* * * * *